US009618191B2

(12) United States Patent
Chang et al.

(10) Patent No.: US 9,618,191 B2
(45) Date of Patent: Apr. 11, 2017

(54) LIGHT EMITTING PACKAGE AND LED BULB

(71) Applicant: ADVANCED SEMICONDUCTOR ENGINEERING, INC., Kaohsiung (TW)

(72) Inventors: Hsiao-Chuan Chang, Kaohsiung (TW); Tsung-Yueh Tsai, Kaohsiung (TW)

(73) Assignee: Advanced Semiconductor Engineering, Inc., Kaohsiung (TW)

( * ) Notice: Subject to any disclaimer, the term of this patent is extended or adjusted under 35 U.S.C. 154(b) by 59 days.

(21) Appl. No.: 13/788,268

(22) Filed: Mar. 7, 2013

(65) Prior Publication Data

US 2014/0254181 A1 Sep. 11, 2014

(51) Int. Cl.

| | |
|---|---|
| ***F21V 19/00*** | (2006.01) |
| ***F21V 29/77*** | (2015.01) |
| *F21Y 105/12* | (2016.01) |
| *F21Y 105/10* | (2016.01) |
| *F21K 9/23* | (2016.01) |
| *F21Y 115/10* | (2016.01) |
| *F21Y 107/00* | (2016.01) |

(52) U.S. Cl.

CPC ..... *F21V 19/003* (2013.01); *F21V 29/77* (2015.01); *F21K 9/23* (2016.08); *F21Y 2105/10* (2016.08); *F21Y 2105/12* (2016.08); *F21Y 2107/00* (2016.08); *F21Y 2115/10* (2016.08); *Y10T 29/49002* (2015.01)

(58) Field of Classification Search

CPC ..... F21K 9/135; F21K 9/1355; F21K 9/30; F21K 9/232; F21V 19/0055; F21Y 2111/001; F21Y 2105/003; H01L 2224/06152; F21S 8/036; F21S 8/03; F21S 8/043; F21S 4/20

USPC ..... 362/294, 373

See application file for complete search history.

(56) References Cited

U.S. PATENT DOCUMENTS

| | | | | |
|---|---|---|---|---|
| 6,534,330 | B2 | 3/2003 | Sakamoto et al. | |
| 6,565,231 | B1 * | 5/2003 | Cok | 362/653 |
| 6,770,498 | B2 | 8/2004 | Hsu | |
| 6,793,374 | B2 * | 9/2004 | Begemann | 362/294 |
| 6,967,395 | B1 | 11/2005 | Glenn et al. | |
| 6,995,510 | B2 | 2/2006 | Murakami et al. | |
| 7,098,588 | B2 | 8/2006 | Jäger et al. | |
| 7,128,442 | B2 | 10/2006 | Lee et al. | |

(Continued)

OTHER PUBLICATIONS

Feng et al.; "Packaging and AC Powering of LED Array", Electronic Components and Technology Conference (ECTC), 2010 Proceedings 60th, 512, (Jun. 2010).

(Continued)

*Primary Examiner* — Julie Bannan

(74) *Attorney, Agent, or Firm* — Klein, O'Neill & Singh, LLP

(57) ABSTRACT

A light emitting package includes a metal plate, a plurality of LED chips, a plurality of leads and a molding compound. The metal plate has a first surface and a second surface, and is bent into two chip mounting portions, wherein an inclination angle is between the chip mounting portions. The LED chips are mounted on the first surface and the second surface of the chip mounting portions. The leads are disposed adjacent to the metal plate and electrically connected to the LED chips. The molding compound encapsulates the LED chips and a part of the lead.

33 Claims, 10 Drawing Sheets

(56) References Cited

U.S. PATENT DOCUMENTS

| | | | | |
|---|---|---|---|---|
| 7,297,293 | B2 | 11/2007 | Tamaki et al. | |
| 7,372,198 | B2 | 5/2008 | Negley | |
| 7,663,095 | B2 | 2/2010 | Wong et al. | |
| 7,695,990 | B2 | 4/2010 | Sorg et al. | |
| 8,044,420 | B2 | 10/2011 | Lee et al. | |
| 2004/0084681 | A1 | 5/2004 | Roberts | |
| 2005/0189557 | A1* | 9/2005 | Mazzochette | F21K 9/00 257/100 |
| 2005/0207152 | A1* | 9/2005 | Maxik | F21K 9/90 362/231 |
| 2005/0247944 | A1 | 11/2005 | Haque et al. | |
| 2006/0118807 | A1 | 6/2006 | Ives et al. | |
| 2008/0062701 | A1 | 3/2008 | Harrah et al. | |
| 2008/0121921 | A1 | 5/2008 | Loh et al. | |
| 2008/0194061 | A1 | 8/2008 | Medendorp | |
| 2008/0217637 | A1 | 9/2008 | Kim et al. | |
| 2009/0001869 | A1 | 1/2009 | Tanimoto et al. | |
| 2009/0080187 | A1* | 3/2009 | Chou | 362/231 |
| 2009/0135595 | A1* | 5/2009 | Chen | 362/235 |
| 2010/0270571 | A1 | 10/2010 | Seo | |
| 2011/0038152 | A1* | 2/2011 | Kuegler | 362/249.02 |
| 2011/0073896 | A1 | 3/2011 | Xu | |
| 2011/0075431 | A1* | 3/2011 | Wu | 362/373 |
| 2011/0163683 | A1* | 7/2011 | Steele | F21K 9/135 315/192 |
| 2011/0278609 | A1 | 11/2011 | Jeong et al. | |
| 2011/0278610 | A1 | 11/2011 | Jeong et al. | |
| 2012/0032577 | A1* | 2/2012 | Huang | 313/318.01 |
| 2012/0069570 | A1* | 3/2012 | Marinus et al. | 362/249.02 |
| 2015/0267872 | A1* | 9/2015 | Huang | F21K 9/232 362/249.06 |

OTHER PUBLICATIONS

Jordan et al.; "Optimized heat transfer and homogeneous color converting for ultra high brightness LED package," Proc. SPIE 6198, 61980B (2006).

* cited by examiner

LIGHT EMITTING PACKAGE AND LED BULB

BACKGROUND OF THE INVENTION

Field of the Invention

The present application relates to a light emitting package and a LED bulb, and more particularly to a light emitting package having a plurality of light emitting diodes and a LED bulb having the same.

Description of the Related Art

A light emitting diode (LED) is widely used in an illumination apparatus for the purpose of high emitting efficiency, small size and saving of electricity. The conventional LED bulb includes a plate substrate and a plurality of LED chips arranged in an array and mounted on the plate substrate. However, the conventional LED bulb has the problem of low light emitting angle. In addition, the plate substrate includes an insulation material therein, thus, the heat dissipating efficiency of the conventional LED bulb is low. Therefore, the application of the conventional LED is limited.

SUMMARY OF THE INVENTION

A light emitting diode (LED) bulb includes a first chip mounting portion having a first surface and a second surface and a second chip mounting portion having a first surface and a second surface. LED chips are mounted on the first surface and the second surface of the first chip mounting portion and on the first surface and the second surface of the second chip mounting portion.

The arrangement density of the LED chips on the second surface of the first chip mounting portion near the second chip mounting portion is less than the arrangement density of the LED chips on the second surface of the first chip mounting portion away the second chip mounting portion. Similarly, the arrangement density of the LED chips on the second surface of the second chip mounting portion near the first chip mounting portion is less than the arrangement density of the LED chips on the second surface of the second chip mounting portion away the first chip mounting portion. By reducing the arrangement density of the LED chips near the junction of the first chip mounting portion and the second chip mounting portion, a uniform light output is achieved.

BRIEF DESCRIPTION OF THE DRAWINGS

Common reference numerals are used throughout the drawings and the detailed description to indicate the same elements. The present invention will be more apparent from the following detailed description taken in conjunction with the accompanying drawings.

DETAILED DESCRIPTION OF THE INVENTION

Figure 1:
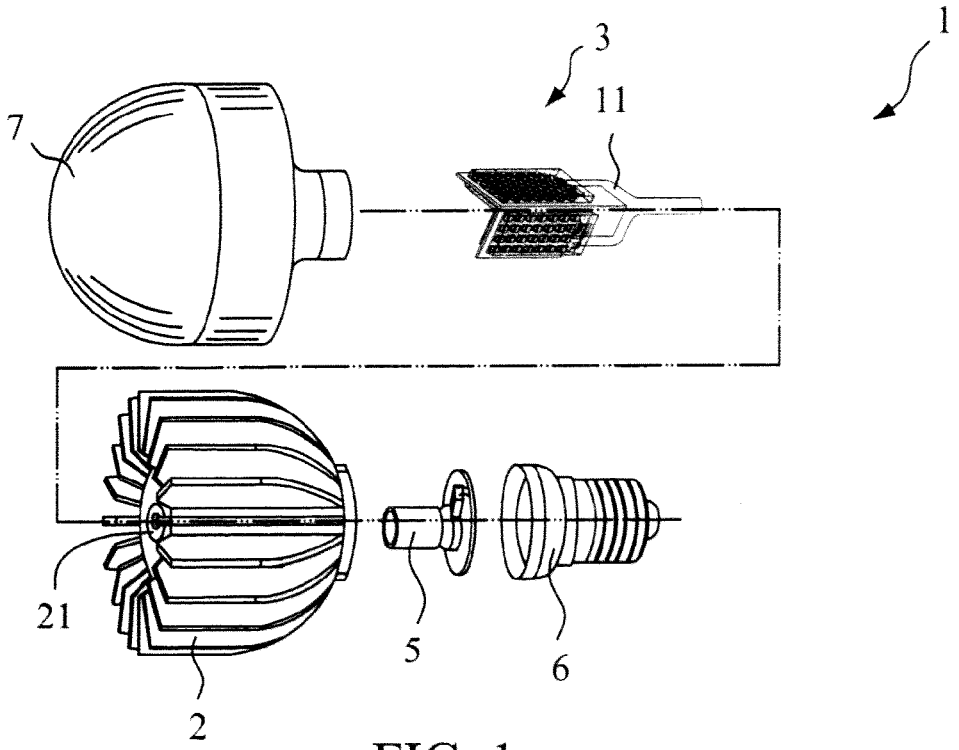
FIG. 1 illustrates a perspectively exploded view of a LED bulb according to an embodiment.

Referring to FIG. 1, a perspectively exploded view of a light emitting diode (LED) bulb 1 according to an embodiment is illustrated. The LED bulb 1 comprises a heat sink 2, a light emitting package 3, an optical housing 7, a power supply 5 and a socket 6. The heat sink 2 is used to dissipate the heat from the light emitting package 3. In this embodiment, the heat sink 2 has an opening 21 and a plurality of fins and the material of the heat sink 2 is copper (Cu) or aluminum (Al).

The light emitting package 3 is connected to the heat sink 2. In this embodiment, the light emitting package 3 is fixed to a rod 11, and the rod 11 is mounted to the heat sink 2 with good thermal contact therebetween. For example, the rod 11 is inserted into and securely attached to the opening 21 of the heat sink 2 using different known methods or materials such as thermally conductive bonding materials or a thermal grease.

The optical housing 7 is connected or mounted to the heat sink 2 and accommodates the light emitting package 3. In this embodiment, the optical housing 7 is in a ball shape, and a coating layer may be coated on the wall of the optical housing 7 to diffuse the light from the light emitting package 3.

The power supply 5 is electrically connected to the light emitting package 3. In this embodiment, the power supply 5 is connected to the back end of the heat sink 2, and has a plurality of connectors (e.g., wires) (not shown) connected to the light emitting package 3 so as to supply electrical power to the light emitting package 3.

The socket 6 is electrically connected to the power supply 5 and used for electrically connecting an external power source (not shown) so as to supply electrical power to the light emitting package 3 through the power supply 5.

Figure 2:
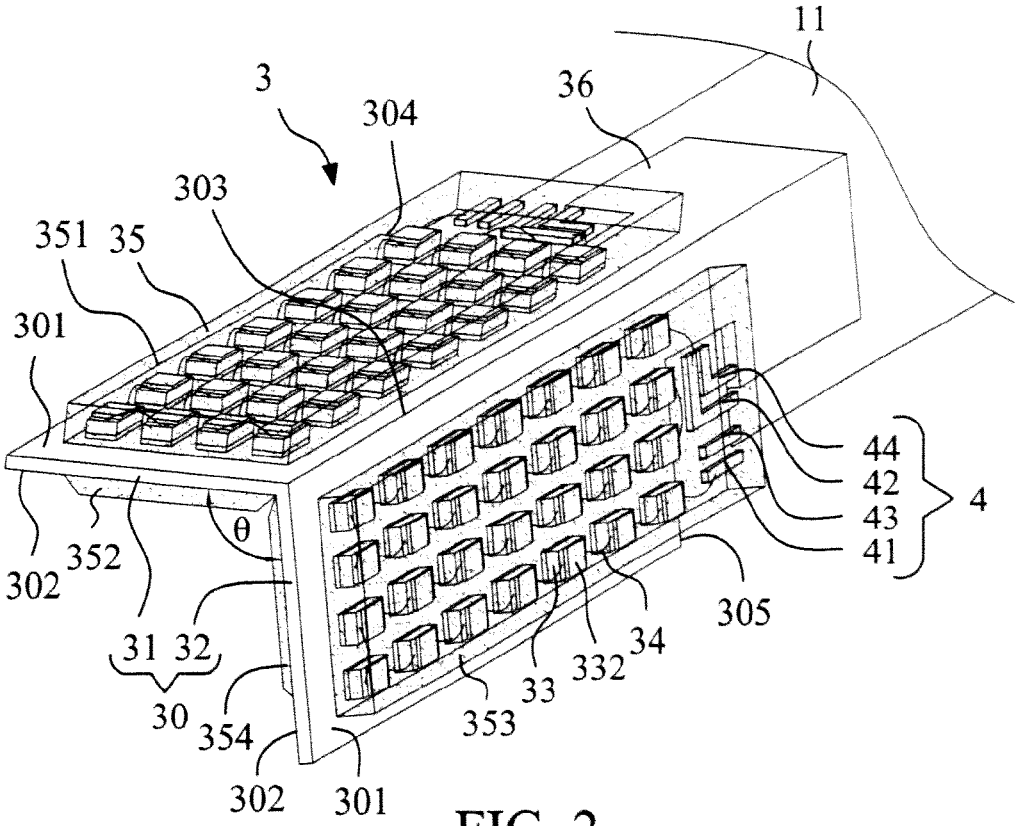
FIG. 2 illustrates a perspective view of a light emitting package of FIG. 1 according to an embodiment.

Referring to FIG. 2, a perspective view of the light emitting package 3 of FIG. 1 according to an embodiment is illustrated. The light emitting package 3 comprises a metal plate 30, a plurality of LED chips 33, a plurality of light converting layers 332, a plurality of leads 4, a molding compound 35 and an extending portion 36.

The metal plate 30 has a first surface 301 and a second surface 302, and is bent into two chip mounting portions 31, 32 to form a V shape thereby providing omnidirectional emission patterns with limited emission variations at different emission angles. Thus, a central bending line or a central bending portion 303 is formed, and an inclination angle θ is between the chip mounting portions 31, 32. More particularly, the inclination angle θ is the angle between the plane defined by the second surface 302 of the chip mounting portion 31 and the plane defined by the second surface 302 of the chip mounting portion 32.

Note that if the metal plate 30 is not bent as illustrated, the resulted light emitting package will generate a relatively low-intensity illumination in the direction parallel to the extending direction of the metal plate 30 since the LED chip 33 typically has a light emitting angle between 90~150 degrees. The light emitting angle is the variation from normal to the light emitting surface of the LED chips 33. For example, a 90 degree light emitting angle emits light plus or minus 45 degrees from normal. In this embodiment, the material of the metal plate 30 is copper (Cu).

The inclination angle θ depends on the light emitting angle of the LED chip 33. Generally, the inclination angle θ is set between an angle equal to ((180−(the light emitting angle)) and (the light emitting angle). For example, when the LED chip 33 has a light emitting angle of 150 degrees, the inclination angle θ is set between 30 and 150 degrees such that the resulting light emitting package 3 obtains a better light emitting uniformity. Similarly, when the LED chip 33 has a light emitting angle of 120 degrees, the inclination angle θ is set between 60 and 120 degrees; when the LED chip 33 has a light emitting angle of 90 degrees, the inclination angle θ is set as 90 degrees.

The LED chips 33 are mounted on the first surface 301 and the second surface 302 of the chip mounting portions 31, 32. In this embodiment, the LED chips 33 are horizontal type and are electrically connected to each other in series by a plurality of bonding wires 34.

The light converting layers 332 are disposed on the LED chips 33. The light converting layer 332 may be a silicone-based or epoxy resin including particles of a light converting substance, for example, phosphor (also called phosphors). Light, for example, blue light, emitted from the LED chips 33 may be converted by the light converting substance into light of different colors, for example, green, yellow, or red, and the lights of different colors are mixed to generate white light.

The leads 4 are disposed adjacent to the metal plate 30 and electrically connected to the LED chips 33 by the bonding wires 34. The leads 4 are insulated from the metal plate 30, and are insulated from each other.

In this embodiment, the leads 4 include eight leads divided into two groups, each of the groups includes four leads 41, 42, 43, 44 and corresponds to each of the chip mounting portions 31, 32. Two leads 41, 42 in each of the groups are electrically connected to the LED chips 33 on the first surface 301 of each of the chip mounting portions 31, 32. The other leads 43, 44 in each of the groups are electrically connected to the LED chips 33 on the second surface 302 of each of the chip mounting portions 31, 32.

The molding compound 35 encapsulates the LED chips 33 and a part of each of the leads 4. In this embodiment, the molding compound 35 includes four separated molding compounds: a first molding compound 351, a second molding compound 352, a third molding compound 353, and a fourth molding compound 354.

The first molding compound 351 encapsulates the LED chips 33 on the first surface 301 of the chip mounting portion 31, and the second molding compound 352 encapsulates the LED chips 33 on the second surface 302 of the chip mounting portion 31. Further, the first molding compound 351 and the second molding compound 352 extend beyond the edge 304 of the chip mounting portion 31 to encapsulate a part of each of the leads 4, and the other part of each of the leads 4 protrudes from the first molding compound 351 and the second molding compound 352.

The third molding compound 353 encapsulates the LED chips 33 on the first surface 301 of the chip mounting portion 32, and the fourth molding compound 354 encapsulates the LED chips 33 on the second surface 302 of the chip mounting portion 32. Further, the third molding compound 353 and the fourth molding compound 354 extend beyond the edge 305 of the chip mounting portion 32 to encapsulate a part of each of the leads 4, and the other part of each of the leads 4 protrudes from the third molding compound 353 and the fourth molding compound 354.

As shown in FIG. 2, the first molding compound 351 does not contact the third molding compound 353, and the second molding compound 352 may or may not contact the fourth molding compound 354. The material of the molding compound 35 (the first molding compound 351, the second molding compound 352, the third molding compound 353 and the fourth molding compound 354) may be any transparent encapsulant material or translucent encapsulant material, such as silicone-based or epoxy resins. The extending portion 36 is at one end of the metal plate 30, and is fixed to the rod 11 so as to transmit the heat from the LED chips 33 to the rod 11 rapidly.

Figure 3:
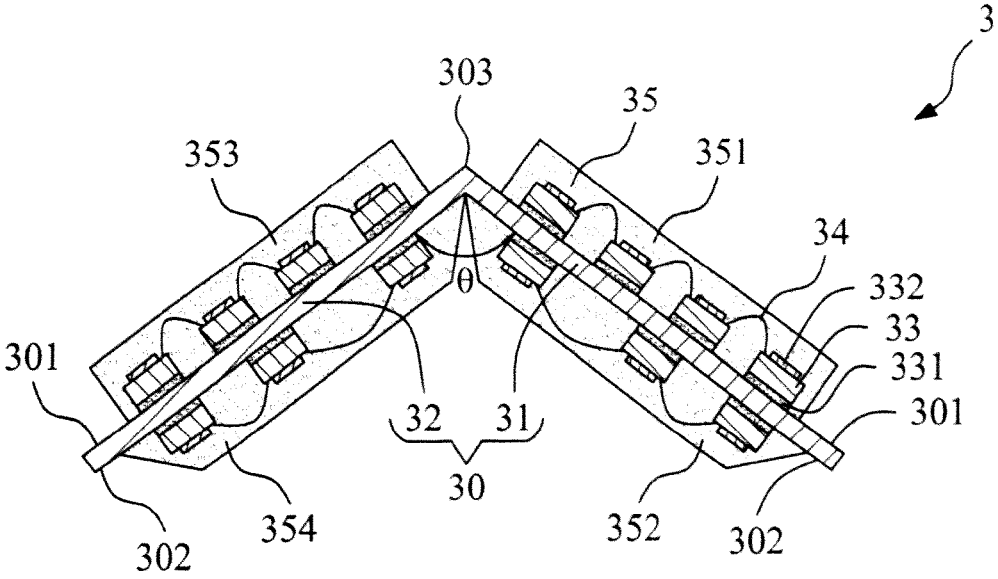
FIG. 3 illustrates a cross-sectional view of the light emitting package of FIG. 2.

Referring to FIG. 3, a cross-sectional view of the light emitting package 3 of FIG. 2 is illustrated. In this embodiment, the supply power of all of the LED chips 33 is the same such that the light emission of each individual LED chip 33 is equal. Therefore, in order to obtain a uniform light output, the arrangement density of the LED chips 33 on the second surface 302 of each of the chip mounting portions 31, 32 near the central bending portion 303 is less than that of the LED chips 33 on the second surface 302 of each of the chip mounting portions 31, 32 away from the central bending portion 303. If the arrangement density was uniform, the relative crowding of the LED chips 33 on the second surface 302 of each of the chip mounting portions 31, 32 near the central bending portion 303 would cause a stronger overall light emission therefrom, compared with the other areas.

Specifically, the pitch between the LED chips 33 on the second surface 302 of each of the chip mounting portions 31, 32 near the central bending portion 303 is less than that of the LED chips 33 on the second surface 302 of each of the chip mounting portions 31, 32 away from the central bending portion 303.

Stated another way, the arrangement density of the LED chips 33 on the second surface 302 of the chip mounting portion 31 near the chip mounting portion 32, i.e., near the junction of the chip mounting portions 31, 32, is less than the arrangement density of the LED chips 33 on the second surface 302 of the chip mounting portion 31 away from the chip mounting portion 32, i.e., away from the junction of the chip mounting portions 31, 32. Similarly, the arrangement density of the LED chips 33 on the second surface 302 of the chip mounting portion 32 near the chip mounting portion 31, i.e., near the junction of the chip mounting portions 31, 32, is less than the arrangement density of the LED chips 33 on the second surface 302 of the chip mounting portion 32 away from the chip mounting portion 31, i.e., away from the junction of the chip mounting portions 31, 32. The arrangement density is the number of LED chips 33 per unit area of the second surface 302 of the chip mounting portions 31, 32.

It is noted that the actual arrangement density of the LED chips 33 depends on the actual inclination angle θ, the power of the LED chips 33 and other conditions. In another embodiment, the arrangement density of the LED chips 33 on the second surface 302 of each of the chip mounting portions 31, 32 may be even, but the supply power of the LED chips 33 on the second surface 302 of each of the chip mounting portions 31, 32 near the central bending portion 303 is less than that of the LED chips 33 on the second surface 302 of each of the chip mounting portions 31, 32 away from the central bending portion 303 in order to obtain a more uniform light output.

In this embodiment, the LED chips 33 are mounted to the metal plate 30 by an adhesive 331 directly. Thus, the heat from the LED chips 33 is transmitted to the rod 11 rapidly through the metal plate 30, and the heat dissipating efficiency of the light emitting package 3 is excellent. Further, all the LED chips 33 are mounted to the two surfaces of the metal plate 30, thus, the density of the LED chips 33 is relative high and the manufacturing cost is relative low.

Figure 4:
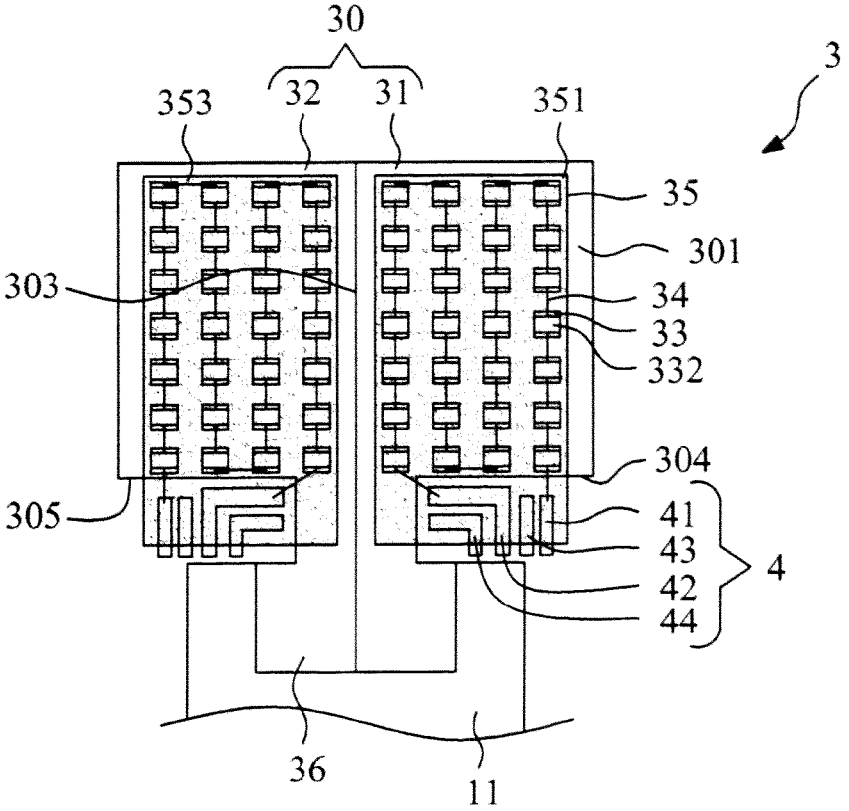
FIG. 4 illustrates a top view of the light emitting package of FIG. 2.

Referring to FIG. 4, a top view of the light emitting package 3 of FIG. 2 is illustrated. The size and the LED chip distribution of the chip mounting portion 31 are equal to that of the chip mounting portion 32. A part of each of the leads 4 is embedded in the molding compound 35, and the other part of each of the leads 4 is exposed from the molding compound 35 for external electrical connection to the power supply 5 (FIG. 1). Specifically, although not shown in the drawings, the exposed parts of the leads 4 are connected (e.g., soldered) to the wires of the power supply 5.

In this embodiment, the LED chips 33 provided on the surfaces 301 and 302 of the chip mounting portion 31 have different arrangement density (best shown in FIG. 3) thereby needing independent power supply. Therefore, two separate leads 41, 43 are used for supplying power, and two separate leads 42, 44 are used for grounding. Specifically, the power leads 41 and the grounding lead 42 are electrically connected to the LED chips 33 on the first surface 301 of each of the chip mounting portions 31, 32, whereas the power leads 43 and the grounding lead 44 are electrically connected to the LED chips 33 on the second surface 302 of each of the chip mounting portions 31, 32.

Figure 5:
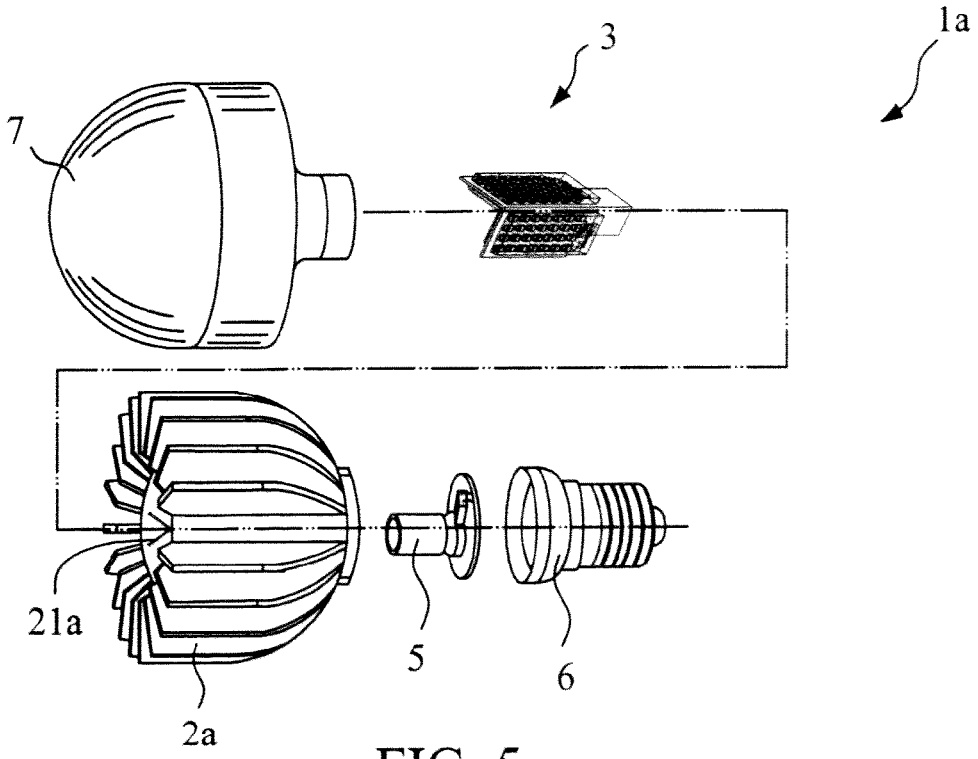
FIG. 5 illustrates a perspectively exploded view of a LED bulb according to another embodiment.
Figure 5A:
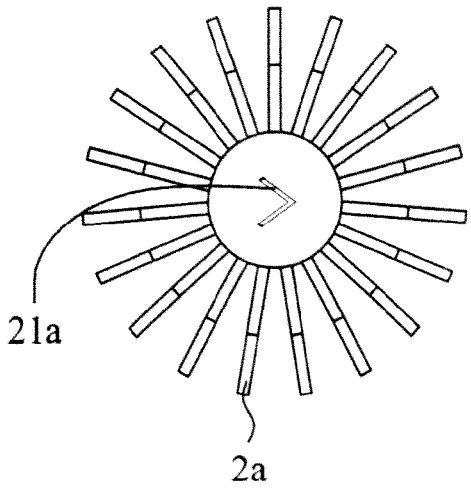
FIG. 5A illustrates a plan view of a heat sink including a V-shaped opening of FIG. 5 according to one embodiment.
Figure 6:
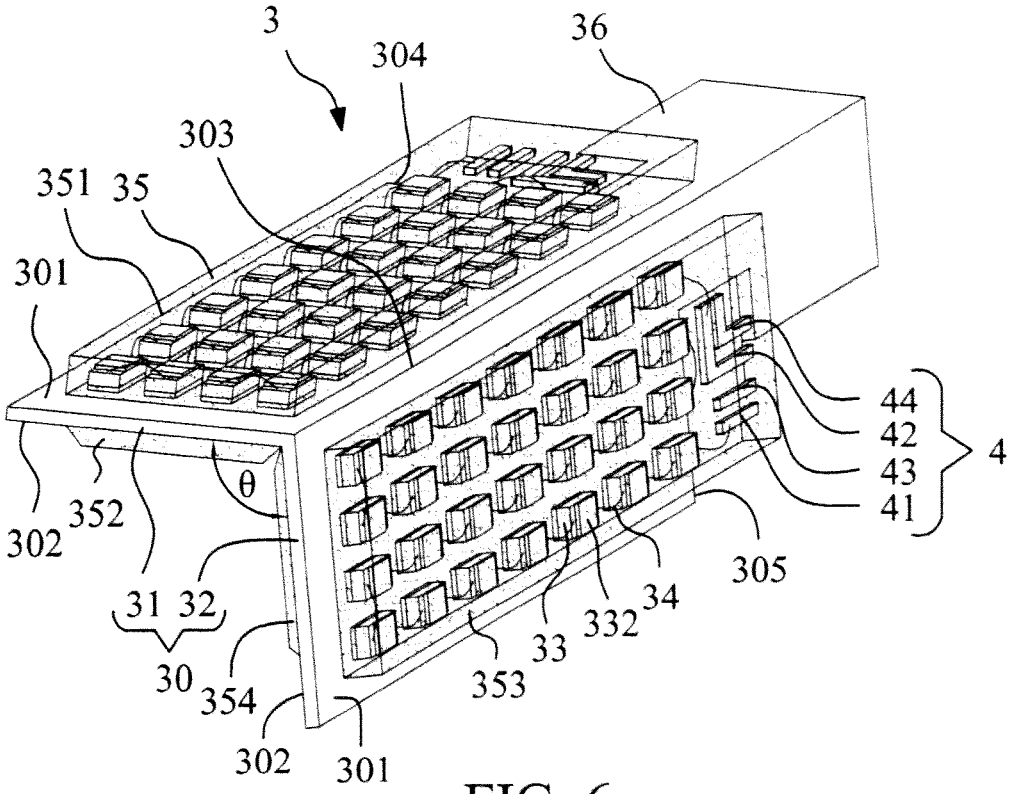
FIG. 6 illustrates a perspective view of a light emitting package of FIG. 5.

Referring to FIG. 5, a perspectively exploded view of a LED bulb 1*a* according to another embodiment is illustrated. FIG. 5A illustrates a plan view from the left looking right of a heat sink 2*a* including a V-shaped opening 21*a* of FIG. 5 according to one embodiment. Referring to FIG. 6, a perspective view of the light emitting package 3 of FIG. 5 is illustrated. The LED bulb 1*a* of this embodiment is substantially similar to the LED bulb 1 of FIG. 1, and the differences are described as follows.

In this embodiment, the light emitting package 3 does not have the rod 11 (FIGS. 1 and 2), and the opening 21*a* of the heat sink 2*a* is of a V shape which corresponds to the two chip mounting portions 31, 32 of the metal plate 30. Thus, the extending portion 36 of the metal plate 30 is inserted into the opening 21*a* of the heat sink 2*a* directly.

Figure 7:
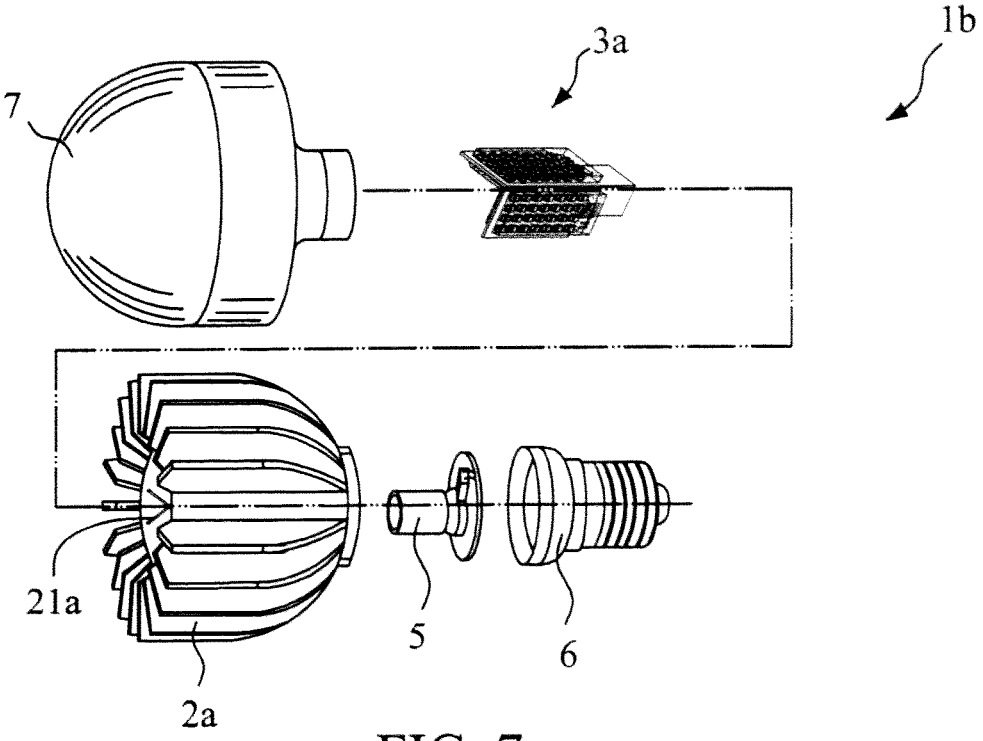
FIG. 7 illustrates a perspectively exploded view of a LED bulb according to another embodiment.
Figure 8:
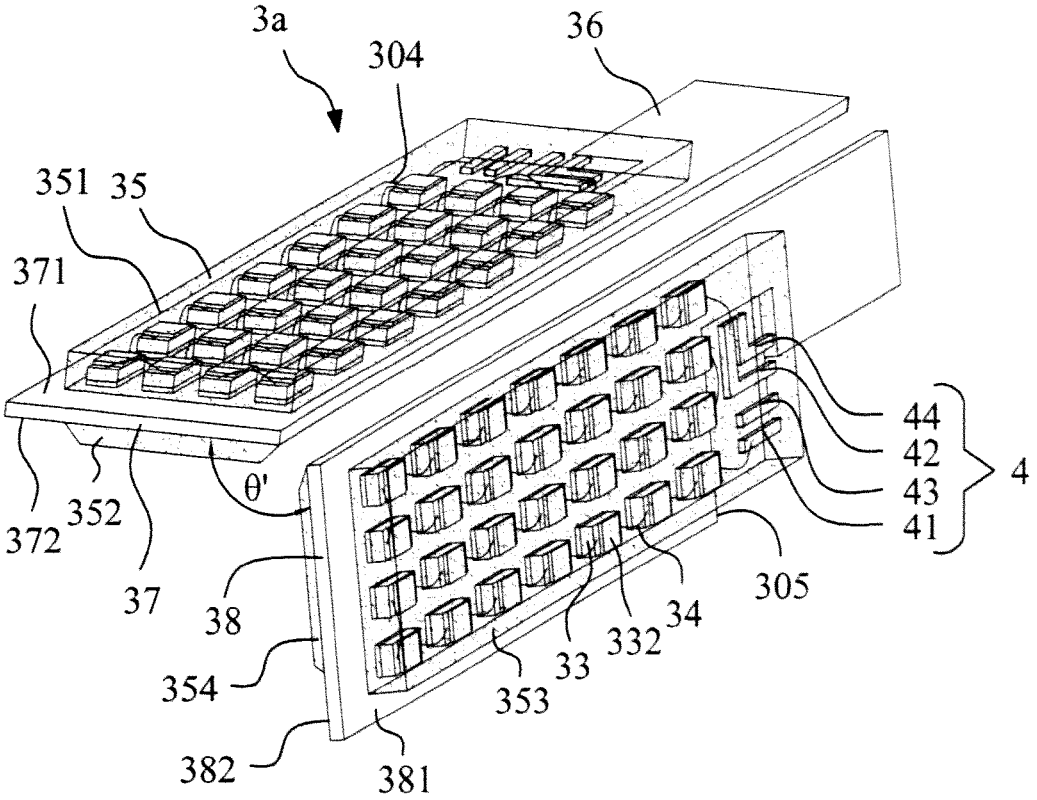
FIG. 8 illustrates a perspective view of a light emitting package of FIG. 7.

Referring to FIG. 7, a perspectively exploded view of a LED bulb 1*b* according to another embodiment is illustrated. Referring to FIG. 8, a perspective view of a light emitting package 3*a* of FIG. 7 is illustrated. The LED bulb 1*b* of this embodiment is substantially similar to the LED bulb 1*a* of FIG. 5, and the differences are described as follows.

In this embodiment, the light emitting package 3*a* comprises two separated metal plates 37, 38 corresponding to the two chip mounting portions 31, 32 of the light emitting package 3 of FIGS. 2 to 4 respectively. The separated metal plates 37, 38 are assembled to the heat sink 2*a*. Specifically, the opening 21*a* of the heat sink 2*a* has two separate grooves, and each of the metal plates 37, 38 is inserted into each of the grooves.

Figure 9:
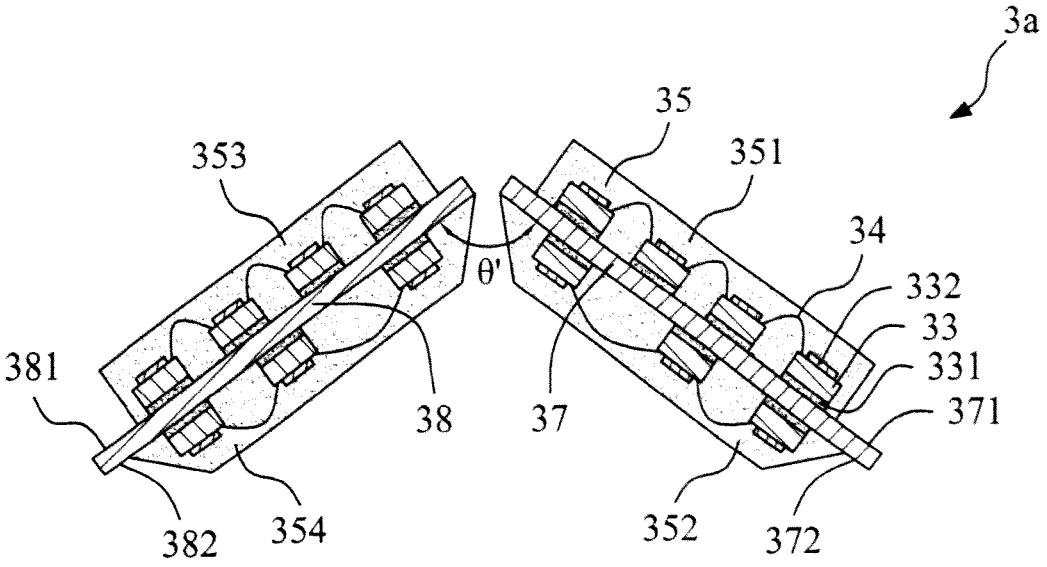
FIG. 9 illustrates a cross-sectional view of the light emitting package of FIG. 8.

Referring to FIG. 9, a cross-sectional view of the light emitting package 3*a* of FIG. 8 is illustrated. The angle θ' included between the separated metal plates 37, 38 may be 30 to 150 degrees.

The metal plate 37 has a first surface 371 and a second surface 372, and the metal plate 38 has a first surface 381 and a second surface 382. The LED chips 33 are mounted on the first surfaces 371, 381 and the second surfaces 372, 382 of the metal plates 37, 38. The density of the LED chips 33 on the second surface 372, 382 of each of the metal plates 37, 38 near the central portion is less than that of the LED chips 33 on the second surface 372, 382 of each of the metal plates 37, 38 away from the central portion.

Similarly to the light emitting package 3 of FIGS. 2 to 4, the leads 4 of this embodiment are divided into two groups, each of the groups corresponds to each of the metal plates 37, 38, some of the leads 4 in each of the groups are electrically connected to the LED chips 33 on the first surface 371, 381 of each of the metal plates 37, 38, and the other leads 4 in each of the groups are electrically connected to the LED chips 33 on the second surface 372, 382 of each of the metal plates 37, 38.

Referring to FIGS. 10 to 18, a method of manufacturing a light emitting package according to an embodiment is illustrated. This embodiment is used to manufacture the light emitting package 3 as shown in FIGS. 2 to 4.

Figure 10:
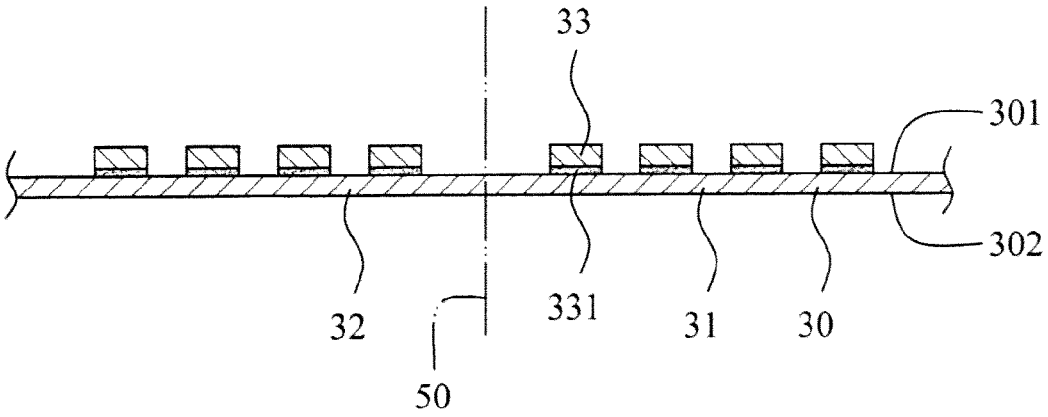
FIGS. 10, 11, 12, 13, 14, 15, 16, 17, 18 illustrate a method of manufacturing a light emitting package according to an embodiment.

Referring to FIG. 10, the metal plate 30 is provided. The metal plate 30 has a first surface 301 and a second surface 302. In this embodiment, the material of the metal plate 30 is copper (Cu). The metal plate 30 is divided into two chip mounting portions 31, 32 by a middle line 50.

Then, the LED chips 33 are mounted on the first surface 301 of the chip mounting portions 31, 32 through the adhesive 331. In this embodiment, the LED chips 33 are horizontal type. The density of the LED chips 33 on the first surface 301 of each of the chip mounting portions 31, 32 is even, thus, the pitches between the LED chips 33 on the first surface 301 of each of the chip mounting portions 31, 32 are equal.

Figure 11:
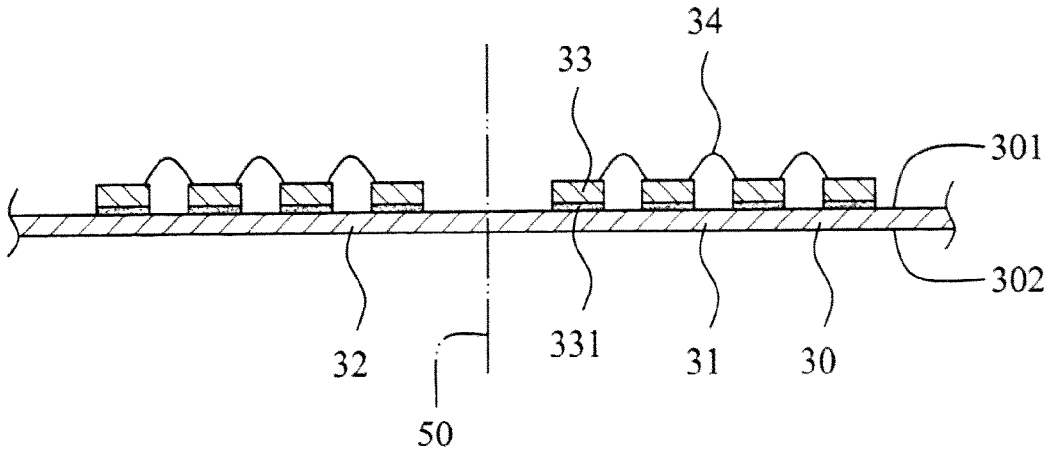

Referring to FIG. 11, the LED chips 33 on the first surface 301 of each of the chip mounting portions 31, 32 are electrically connected to each other in series by the bonding wires 34.

Figure 12:
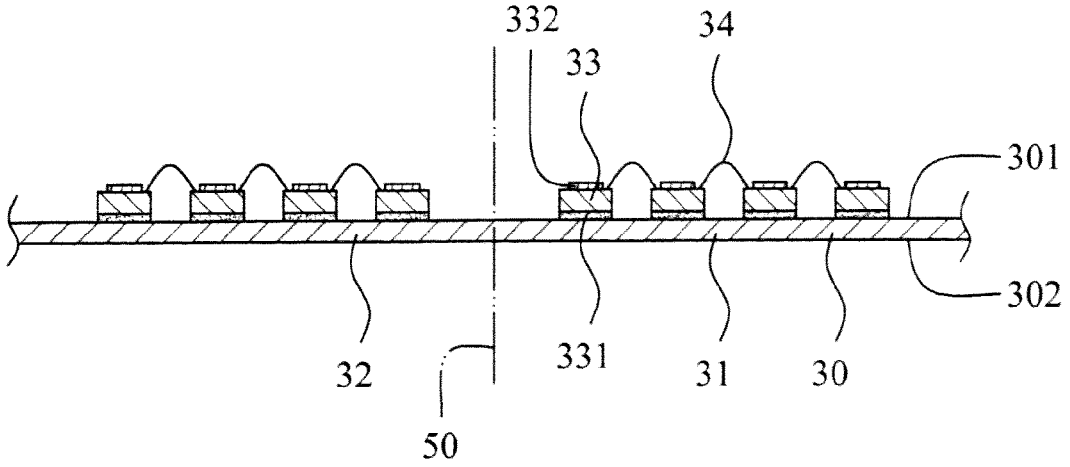

Referring to FIG. 12, the light converting layers 332 are applied on the top surfaces of the LED chips 33. The light converting layer 332 may be a silicone-based or epoxy resin including particles of a light converting substance, for example, phosphor (also called phosphors).

Figure 13:
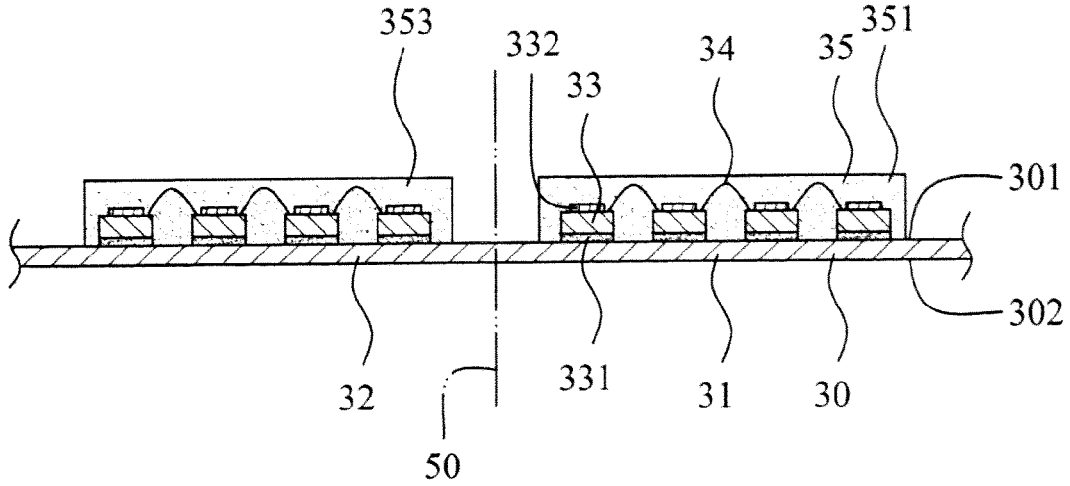

Referring to FIG. 13, the molding compound 35 is applied to encapsulate the LED chips 33. In this step of this embodiment, the molding compound 35 includes two separated molding compounds: the first molding compound 351 encapsulating the LED chips 33 on the chip mounting portion 31, and the third molding compound 353 encapsulating the LED chips 33 on the chip mounting portion 32. The first molding compound 351 does not contact the third molding compound 353. The first molding compound 351 and the third molding compound 353 are disposed on two sides of the middle line 50.

Figure 14:
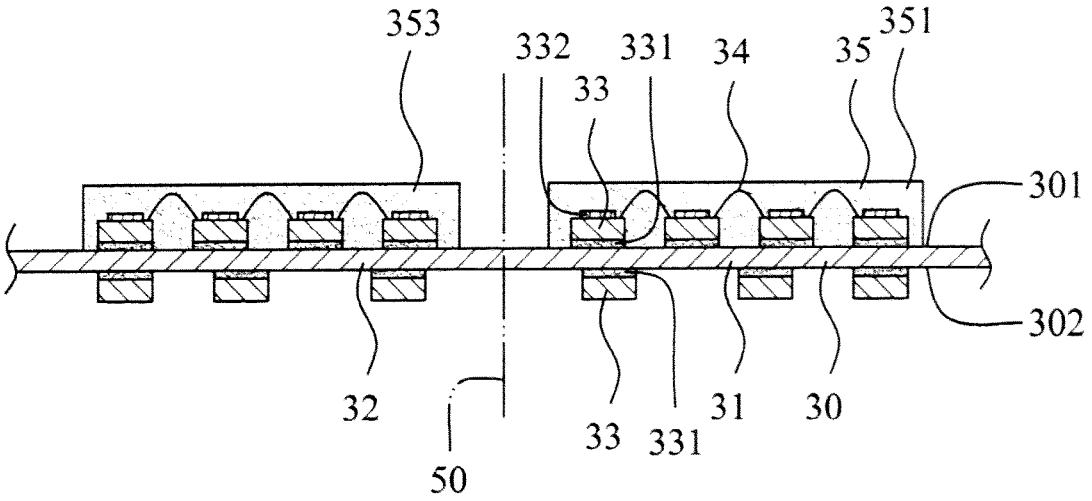

Referring to FIG. 14, the LED chips 33 are further mounted on the second surface 302 of the chip mounting portions 31, 32 through the adhesive 331. In this embodiment, the power of all of the LED chips 33 are the same, and the density of the LED chips 33 on the second surface 302 of each of the chip mounting portions 31, 32 near the middle line 50 is less than that of the LED chips 33 on the second surface 302 of each of the chip mounting portions 31, 32 away from the middle line 50. Thus, the pitch between the LED chips 33 on the second surface 302 of each of the chip mounting portions 31, 32 near the middle line 50 is less than that of the LED chips 33 on the second surface 302 of each of the chip mounting portions 31, 32 away from the middle line 50.

However, in other embodiment, the density of the LED chips 33 on the second surface 302 of each of the chip mounting portions 31, 32 is even, but the power of the LED chips 33 on the second surface 302 of each of the chip mounting portions 31, 32 near the middle line 50 is less than that of the LED chips 33 on the second surface 302 of each of the chip mounting portions 31, 32 away from the middle line 50.

Figure 15:
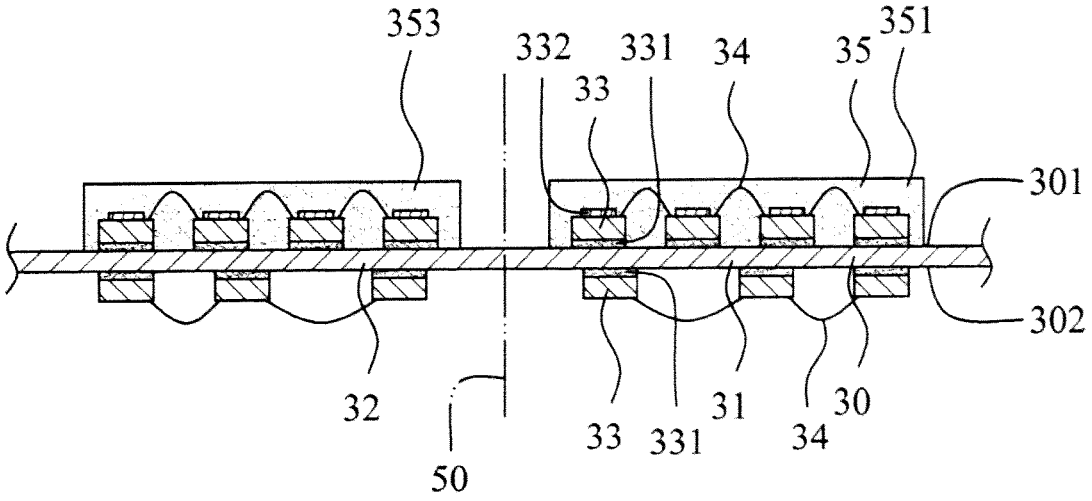

Referring to FIG. 15, the LED chips 33 on the second surface 302 of each of the chip mounting portions 31, 32 are electrically connected to each other in series by the bonding wires 34.

Figure 16:
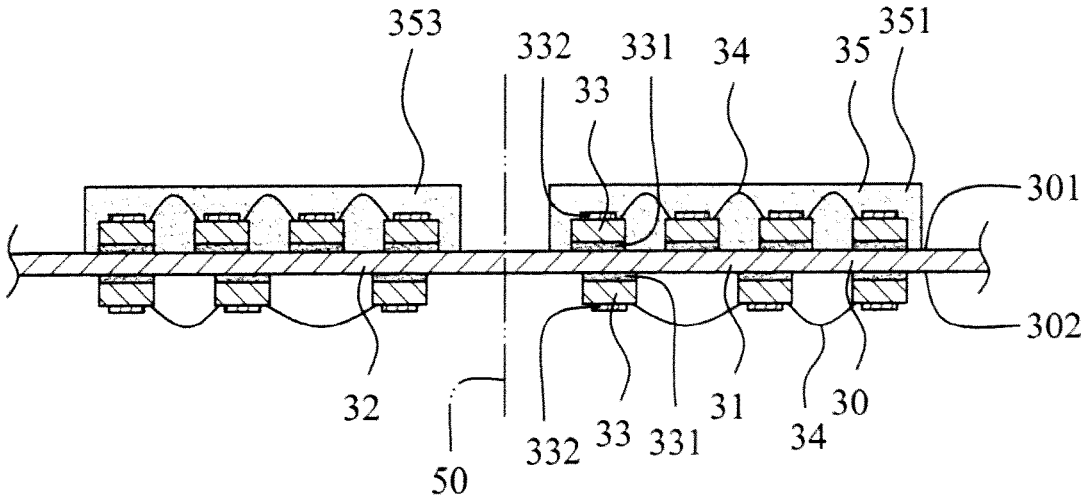

Referring to FIG. 16, the light converting layers 332 are applied on the top surfaces of the LED chips 33.

Figure 17:
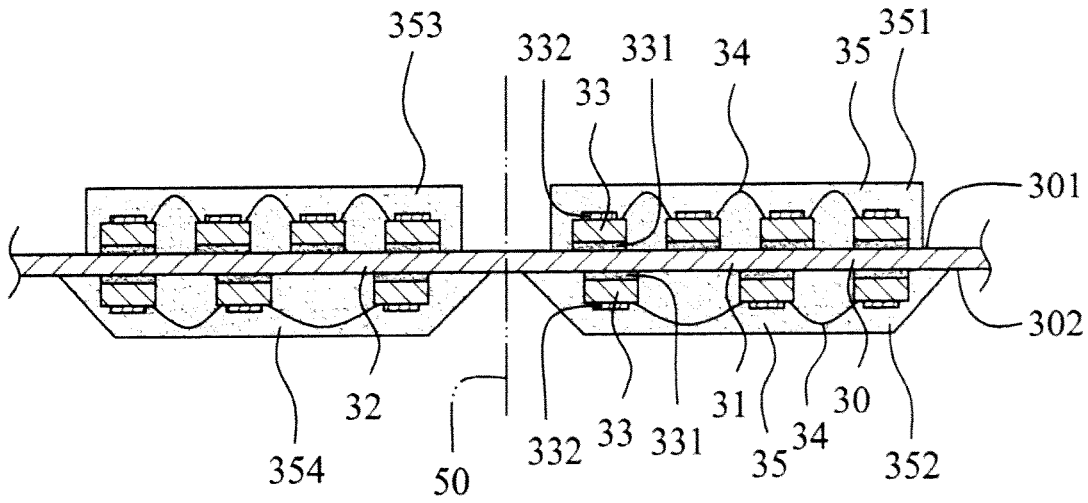

Referring to FIG. 17, the molding compound 35 is applied to encapsulate the LED chips 33. In this step of this embodiment, the molding compound 35 further includes two separated molding compounds: the second molding compound 352 encapsulating the LED chips 33 on the chip mounting portion 31, and the fourth molding compound 354 encapsulating the LED chips 33 on the chip mounting portion 32. The second molding compound 352 does not contact the fourth molding compound 354. The second molding compound 352 and the fourth molding compound 354 are disposed on two sides of the middle line 50.

Figure 18:
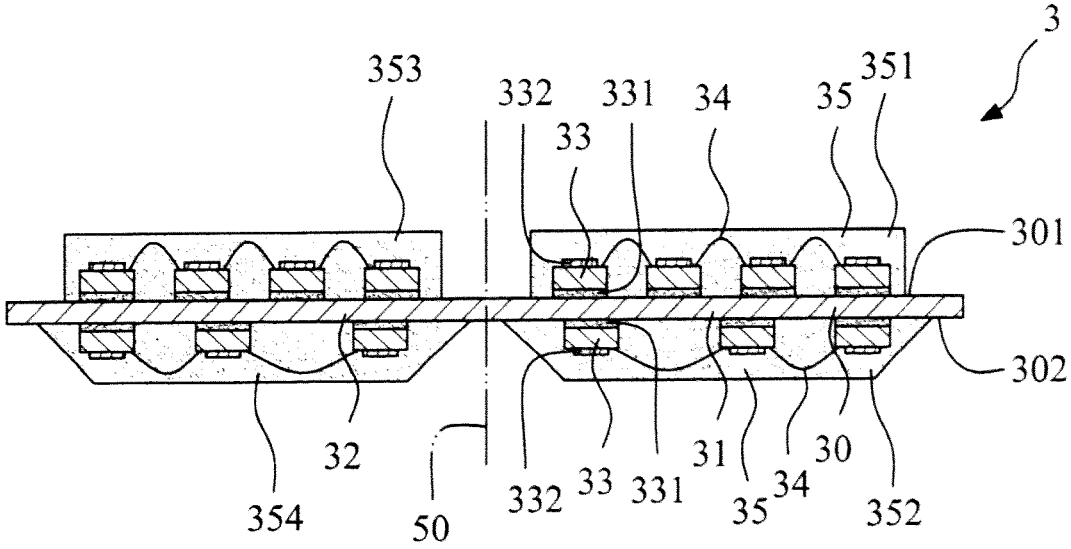

Referring to FIG. 18, the metal plates 30 are cut to form a plurality of light emitting packages 3. Then, the light emitting package 3 is bent along the middle line 50 as to become the light emitting package 3 as shown in FIGS. 2 to 4.

While the invention has been described and illustrated with reference to specific embodiments thereof, these descriptions and illustrations do not limit the invention. It should be understood by those skilled in the art that various changes may be made and equivalents may be substituted without departing from the true spirit and scope of the invention as defined by the appended claims. The illustrations may not be necessarily drawn to scale. There may be distinctions between the artistic renditions in the present disclosure and the actual apparatus due to manufacturing processes and tolerances. There may be other embodiments of the present invention which are not specifically illustrated. The specification and the drawings are to be regarded as illustrative rather than restrictive. Modifications may be made to adapt a particular situation, material, composition of matter, method, or process to the objective, spirit and scope of the invention. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the invention. Accordingly, unless specifically indicated herein, the order and grouping of the operations are not limitations of the invention.

What is claimed is:

1. A structure comprising:

a first device mounting portion comprising a first surface and a second surface;

a second device mounting portion comprising a first surface and a second surface; and a plurality of light emitting devices mounted on the first and second surfaces of the first device mounting portion, and on the first and second surfaces of the second device mounting portion, wherein the light emitting devices on the second surface of the first device mounting portion are arranged in a plurality of columns, spaced by a pitch that decreases with increasing distance from the second device mounting portion, and wherein the light emitting devices on the second surface of the second device mounting portion are arranged in a plurality of columns, spaced by a pitch that decreases with increasing distance from the first device mounting portion.

2. The structure of claim 1, wherein the first device mounting portion comprises a first metal plate, and the second device mounting portion comprises a second metal plate, and the structure further comprises:

a heat sink with an opening comprising a first groove configured to receive the first metal plate and a second groove, and a second groove configured to receive the second metal plate.

3. The structure of claim 1, wherein the first device mounting portion is a first portion of a metal plate and the second device mounting portion is a second portion of the metal plate, the metal plate including a central bending portion between the first and second portions of the metal plate, and the structure further comprises:

an extending portion of the metal plate; and a heat sink having an opening configured to receive the extending portion of the metal plate.

4. A structure comprising:

a first device mounting portion comprising a first surface and a second surface;

a second device mounting portion comprising a first surface and a second surface;

a first plurality of light emitting devices mounted on the first surfaces of the first and second device mounting portions with a uniform pitch in a plurality of columns; and a second plurality of light emitting devices mounted on the second surfaces of the first and second device mounting portions with a non-uniform pitch in a plurality of columns.

5. A structure comprising:

a first chip mounting portion comprising a first surface and a second surface;

a second chip mounting portion comprising a first surface and a second surface; and a plurality of optical chips mounted on the first and second surfaces of the first chip mounting portion, and on the first and second surfaces of the second chip mounting portion, wherein the optical chips on the second surface of the first chip mounting portion are arranged in a plurality of columns, spaced by a pitch that decreases with increasing distance from the second chip mounting portion, and wherein the optical chips on the second surface of the second chip mounting portion are arranged in a plurality of columns, spaced by a pitch that decreases with increasing distance from the first chip mounting portion.

6. The structure of claim 5, wherein an inclination angle is defined between the first chip mounting portion and the second chip mounting portion.

7. The structure of claim 6, wherein the inclination angle is between 30 and 150 degrees.

8. The structure of claim 6, wherein the inclination angle is the angle between a plane defined by the second surface of the first chip mounting portion and a plane defined by the second surface of the second chip mounting portion.

9. The structure of claim 6, wherein the optical chips define a light-emitting angle, and wherein the inclination angle is between the light emitting angle of the optical chips and an angle that is supplementary to the light emitting angle of the optical chips.

10. The structure of claim 5, wherein the plurality of columns of optical chips mounted to the second surface of the first chip mounting portion get closer together as a placement of each column gets farther from the second chip mounting portion.

11. The structure of claim 5, wherein the plurality of columns of optical chips mounted to the second surface of the first chip mounting portion get closer together as a placement of each column gets farther from the second chip mounting portion.

12. The structure of claim 5, wherein the optical chips on the first surface of the first chip mounting portion and the first surface of the second chip mounting portion are spaced by a uniform pitch.

13. The structure of claim 5, wherein the first chip mounting portion is a first portion of a metal plate and the second chip mounting portion is a second portion of the metal plate, the metal plate including a central bending portion between the first and second portions of the metal plate.

14. The structure of claim 5, wherein the first chip mounting portion comprises a first metal plate, and the second chip mounting portion comprises a second metal plate.

15. The structure of claim 14, further comprising:

a heat sink with an opening comprising a first groove configured to receive the first metal plate and a second groove, and a second groove configured to receive the second metal plate.

16. The structure of claim 5, further comprising:

a plurality of leads electrically connected to the plurality of optical chips; and a molding compound encapsulating the plurality of optical chips and a part of each of the plurality of leads.

17. The structure of claim 13, further comprising:

an extending portion of the metal plate; and a heat sink having an opening configured to receive the extending portion of the metal plate.

18. A structure comprising:

a first device mounting portion comprising a first surface and a second surface;

a second device mounting portion comprising a first surface and a second surface;

a first plurality of optical chips mounted on the first surfaces of the first and second device mounting portions with a uniform pitch in a plurality of columns; and a second plurality of optical chips mounted on the second surfaces of the first and second device mounting portions with a non-uniform pitch in a plurality of columns.

19. The structure of claim 18, wherein an inclination angle is the angle between a plane defined by the second surface of the first device mounting portion and a plane defined by the second surface of the second device mounting portion.

20. The structure of claim 18, wherein the optical chips of the first and second pluralities of optical chips have a light emitting angle; and wherein an inclination angle is defined between the first device mounting portion and the second device mounting portion, the inclination angle having a value between the light emitting angle of the optical chips and an angle that is supplementary to the light emitting angle of the optical chips.

21. The structure of claim 18, wherein the non-uniform pitch between the optical chips of the second plurality of optical chips decreases with increasing distance from a juncture defined between the first and second device mounting portions.

22. The structure of claim 18, wherein the first device mounting portion is a first portion of a metal plate and the second device mounting portion is a second portion of the metal plate, the metal plate including a central bending portion between the first and second portions of the metal plate.

23. The structure of claim 18, wherein the first device mounting portion comprises a first metal plate, and the second device mounting portion comprises a second metal plate.

24. The structure of claim 1, wherein the plurality of columns of light emitting devices mounted to the second surface of the first device mounting portion get closer together as a placement of each column gets farther from the second device mounting portion.

25. The structure or claim 4, wherein the plurality of columns or light emitting devices mounted to the second surface of the first device mounting portion get closer together as a placement of each column gets farther from the second device mounting portion.

26. The structure of claim 1, wherein light emitting devices are light emitting chips.

27. The structure of claim 26, light emitting chips are light emitting diodes (LEDs).

28. The structure of claim 27, wherein the LEDs are connected in series.

29. The structure of claim 4, wherein light emitting devices are light emitting chips.

30. The structure of claim 29, light emitting chips are light emitting diodes (LEDs).

31. The structure of claim 30, wherein the LEDs are connected in series.

32. The structure of claim 5, wherein the optical chips are connected in series.

33. The structure of claim 18, wherein the optical chips are connected in series.

* * * * *